US008478167B2

(12) United States Patent
Maeda

(10) Patent No.: US 8,478,167 B2
(45) Date of Patent: Jul. 2, 2013

(54) IMAGE FORMING APPARATUS AND IMAGE FORMING METHOD

(75) Inventor: Ryota Maeda, Osaka (JP)

(73) Assignee: Kyocera Mita Corporation (JP)

( * ) Notice: Subject to any disclaimer, the term of this patent is extended or adjusted under 35 U.S.C. 154(b) by 348 days.

(21) Appl. No.: 12/958,479

(22) Filed: Dec. 2, 2010

(65) Prior Publication Data

US 2011/0135342 A1 Jun. 9, 2011

(30) Foreign Application Priority Data

Dec. 8, 2009 (JP) ..... 2009-278527

(51) Int. Cl.
*G03G 15/00* (2006.01)

(52) U.S. Cl.
USPC ..... 399/167; 399/301

(58) Field of Classification Search
USPC ..... 399/78, 167, 299, 300, 301
See application file for complete search history.

(56) References Cited

U.S. PATENT DOCUMENTS 6,278,857 B1 8/2001 Monji et al.

FOREIGN PATENT DOCUMENTS

JP 2000-250285 9/2000
JP 2006243577 9/2006

*Primary Examiner* — Walter L Lindsay, Jr.
*Assistant Examiner* — Barnabas Fekete
(74) *Attorney, Agent, or Firm* — Gerald E. Hespos; Michael J. Porco; Matthew T. Hespos

(57) ABSTRACT

An image forming apparatus is provided with an image forming station including photoconductive drums and adapted to form toner images on surfaces of the respective photoconductive drums, and a drive control unit for rotating and driving the photoconductive drums. The image forming station includes a reference pulse output section for generating a reference pulse having a cycle equal to or an integral multiple of a rotation cycle of the photoconductive drums and outputting the reference pulse to the drive control unit. The drive control unit includes a phase peak detector for detecting phase peaks of surface speeds of the photoconductive drums, a phase difference detector for detecting phase differences between an edge of the reference pulse and the phase peaks, and a phase synchronization controller for synchronizing phases of the surface speeds of the photoconductive drums by controlling rotation speeds of the photoconductive drums according to the phase differences.

11 Claims, 10 Drawing Sheets

IMAGE FORMING APPARATUS AND IMAGE FORMING METHOD

BACKGROUND OF THE INVENTION

1. Field of the Invention

The present invention relates to an image forming apparatus such as a copier or a printer for forming an image using an electrophotographic method and an image forming method.

2. Description of the Related Art

In recent years, a color tandem method has been known as one of image forming methods in image forming apparatuses using an electrophotographic method and represented by copiers and printers. The color tandem method is a method for realizing high-speed full color printing by arranging photoconductive drums of four colors, i.e. black (BK), yellow (Y), magenta (M) and cyan (C) in a row and successively transferring toner images of the respective colors formed (developed) on the respective photoconductive drums to an intermediate transfer member or a transfer member. There exits a prior art document that discloses a technology relating to a correction process for preventing color shift caused due to dimensional errors and mounting errors of mechanical parts such as photoconductive drums in an image forming apparatus employing such a color tandem method.

A surface speed of the photoconductive drum of each color varies due to a rotation variation of a drive motor, pitch unevenness in a transmission gear train for transmitting a drive force of the drive motor, a speed variation caused by eccentric rotation of a gear or a speed variation caused by eccentric rotation of the photoconductive drum itself. Such a surface speed variation of the photoconductive drum repeatedly occurs in a rotational cycle of the photoconductive drum. Position shifts occur among the respective colors due to a variation of fluctuating phases of the respective colors. Accordingly, in the apparatus of the above prior art document, position shifts among the respective colors are prevented by performing a phase synchronization control. The phase synchronization control is a control for detecting phases of the photoconductive drums of the respective colors and independently drive-controlling the respective photoconductive drums so that, with respect to the phase of a specified photoconductive drum as a basis, the other photoconductive drums rotate with predetermined phase differences.

However, if a drive control unit for driving and rotating the respective photoconductive drums and an image forming station for controlling formation of toner images of the respective colors on the surfaces of the respective photoconductive drums are independently constructed, the phase synchronization control as described above is performed by the drive control unit and an image formation control is performed independently of the phases of the respective photoconductive drums in the image forming station. Thus, it has been difficult to recognize phase peaks of the respective photoconductive drums and perform an image forming process in conformity with the phases of the respective photoconductive drums in the image forming station.

Factors of color shift in the image forming apparatus employing the color tandem method are not limited to the dimensional errors and mounting errors of the mechanical parts. For example, image forming apparatuses of recent years are constructed such that a plurality of arithmetic circuits for performing arithmetic processings based on output signals of various sensors and outputting various control signals are provided for faster processing. Generally, these arithmetic circuits are respectively arranged on different substrates to reduce substrate sizes and oscillation circuits as clock signal sources for operations of the respective arithmetic circuits are individually provided on the respective substrates. The oscillation circuits are individually provided on the respective substrates (for the respective arithmetic circuits) because clock transmission quality is problematic due to a high oscillation frequency and unnecessary electromagnetic radiation increases if clock signals generated by the oscillation circuit on a certain substrate are supplied to the other substrates.

However, even if the oscillation circuits are provided on the respective substrates, there is no likelihood that the oscillation frequencies of all the oscillation circuits keep the same relationship since the respective oscillation circuits have tolerances with respect to an ideal oscillation frequency. Such tolerance deviations of the oscillation frequencies present among the oscillation circuits may possibly cause the above color shift. For example, if there is a tolerance deviation in oscillation between an oscillation circuit provided in the drive control unit and the one provided in the image forming station, a relationship between the rotation speeds of the photoconductive drums and exposure processing speeds to the photoconductive drums varies, which may possibly cause the color shift.

SUMMARY OF THE INVENTION

An object of the present invention is to provide an image forming apparatus and an image forming method capable of performing an image forming process in conformity with phases of respective photoconductive drums in a color tandem method.

In order to accomplish this object, one aspect of the present invention is directed to an image forming apparatus, including an image forming station including a plurality of photoconductive drums and adapted to form toner images on surfaces of the respective photoconductive drums; and a drive control unit for rotating and driving the plurality of photoconductive drums, wherein the image forming station includes a reference pulse output section for generating a reference pulse having a cycle which is equal to or an integral multiple of a rotation cycle of the photoconductive drums and outputting the reference pulse to the drive control unit; and the drive control unit includes a phase peak detector for detecting phase peaks of surface speeds of the respective photoconductive drums, a phase difference detector for detecting phase differences between an edge of the reference pulse and the phase peaks, and a phase synchronization controller for synchronizing phases of the surface speeds of the respective photoconductive drums by controlling rotation speeds of the respective photoconductive drums according to the phase differences.

Another aspect of the present invention is directed to an image forming method for forming toner images on surfaces of a plurality of photoconductive drums by rotating and driving the photoconductive drums, including the steps of generating a reference pulse having a cycle which is equal to or an integral multiple of a rotation cycle of the photoconductive drums and outputting the reference pulse to a drive control unit for driving and rotating the photoconductive drums; detecting phase peaks of surface speeds of the respective photoconductive drums; detecting phase differences between an edge of the output reference pulse and the phase peaks; and synchronizing phases of the surface speeds of the respective photoconductive drums by controlling rotation speeds of the respective photoconductive drums according to the phase differences.

Other objects of the present invention and advantages obtained by the present invention will become more apparent upon reading the following description of embodiments.

DETAILED DESCRIPTION OF THE PREFERRED EMBODIMENTS

Hereinafter, embodiments of the present invention are described with reference to the drawings. Color laser printers employing a color tandem method are illustrated as image forming apparatuses according to these embodiments.

[First Embodiment]

Figure 1:
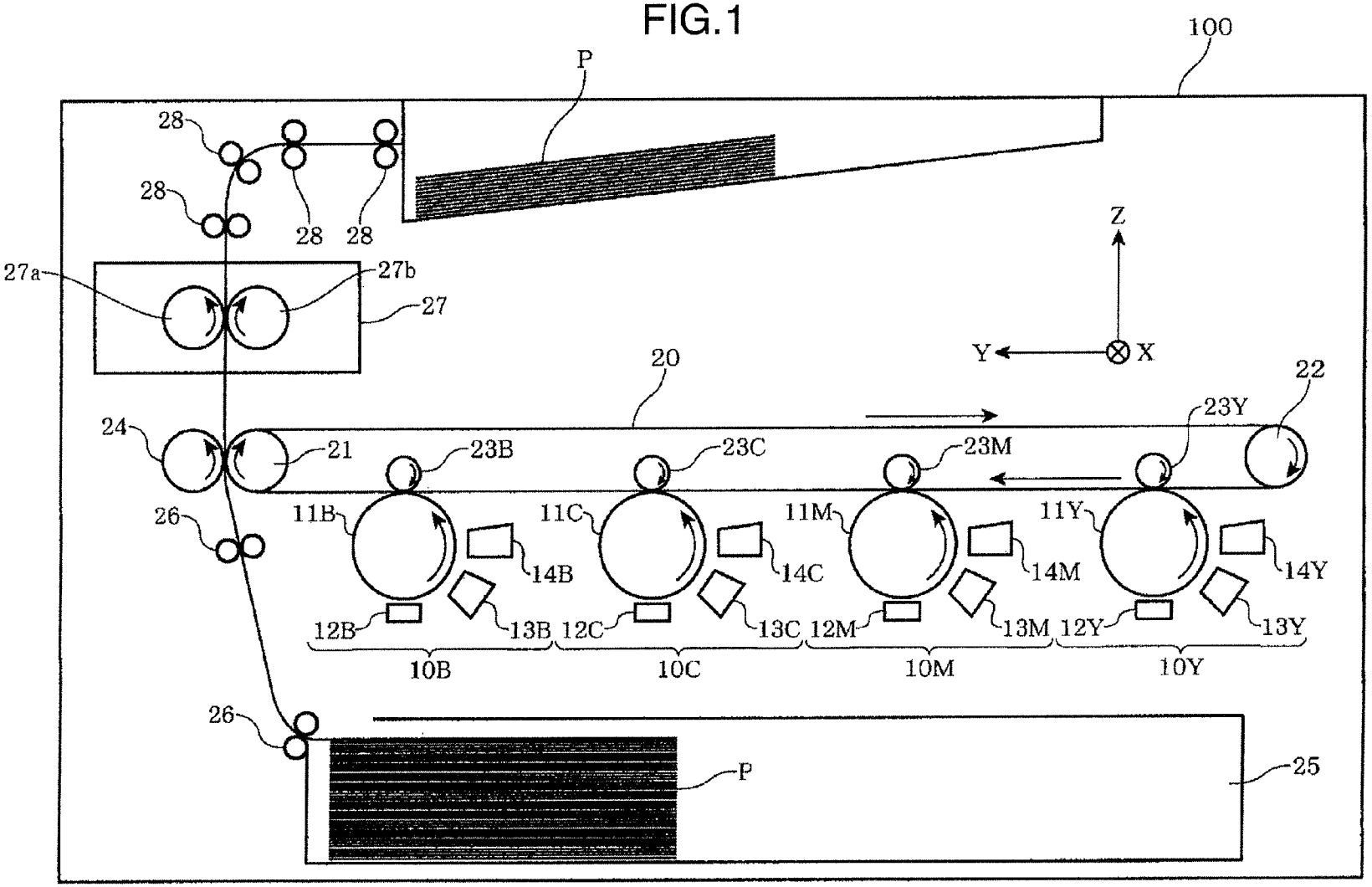
FIG. 1 is a diagram showing a schematic construction of an image forming apparatus according to a first embodiment of the invention.

FIG. 1 is a diagram showing a schematic construction of an image forming apparatus 100 according to one embodiment of the present invention. The image forming apparatus 100 includes image forming units 10Y, 10M, 10C and 10B, an intermediate transfer belt 20, conveyor rollers 21, 22, primary transfer rollers 23Y, 23M, 23C and 23B, a secondary transfer roller 24, a sheet cassette 25, feed rollers 26, a fixing device 27 and discharge rollers 28.

The image forming units 10Y, 10M, 10C and 10B are provided in correspondence with respective four colors of yellow (Y), magenta (M), cyan (C) and black (BK) and arranged in a row along a Y-axis direction (sub scanning direction) in FIG. 1, and successively transfer (primary transfer) toner images of four colors, i.e. yellow, magenta, cyan and black to the intermediate transfer belt 20 by charging, exposure, development and transfer processes. Detailed constructions of these image forming units 10Y, 10M, 10C and 10B are described below. Since main constructions of the respective units are the same except for colors of developers (toners) used, the image forming unit 10Y is described as a representative.

The image forming unit 10Y includes a photoconductive drum 11Y, a charger 12Y, an exposure device 13Y and a developing device 14Y. The photoconductive drum 11Y is a cylindrical electrostatic latent image bearing member with a rotary shaft extending in an X-axis direction (main scanning direction) in FIG. 1 and is arranged rotatably in a rotating direction indicated by an arrow in FIG. 1. The photoconductive drum 11Y and the primary transfer roller 23Y face each other while sandwiching the intermediate transfer belt 20 therebetween. The charger 12Y extends in a direction of the rotary shaft of the photoconductive drum 11Y (i.e. X-axis direction). The charger 12Y discharges negative electric charges toward a surface of the photoconductive drum 11Y to uniformly charge the surface of the photoconductive drum 11Y (charging process).

The exposure device 13Y includes a laser scanning unit (LSU) composed of unillustrated laser light source, polygonal mirror, polygon motor and the like. Laser light emitted from the laser light source is irradiated to the surface of the photoconductive drum 11Y while being scanned in the main scanning direction of the photoconductive drum 11Y by the polygon mirror being driven and rotated. By this irradiation, negative electric charges at a specified position on the surface of the photoconductive drum 11Y are removed to form an electrostatic latent image corresponding to a yellow image (exposure process).

The developing device 14Y extends in the direction of the rotary shaft of the photoconductive drum 11Y, receives supply of toner from an unillustrated yellow toner cartridge, and supplies this toner toward the surface of the photoconductive drum 11Y. By the supply of the toner, a toner image corresponding to the electrostatic latent image formed by the exposure process is formed on the surface of the photoconductive drum 11Y (development process). The toner image formed on the surface of the photoconductive drum 11Y is transferred onto the intermediate transfer belt 20 moving in the Y-axis direction between the photoconductive drum 11Y and the primary transfer roller 23Y (primary transfer process). Specifically, a predetermined transfer voltage is applied to the primary transfer roller 23Y to positively charge the intermediate transfer belt 20, whereby the toner image formed on the surface of the photoconductive drum 11Y is transferred onto the intermediate transfer belt 20.

The other image forming units 10M, 10C and 10B have constructions similar to that of the image forming unit 10Y described above. Specifically, the image forming unit 10M includes a photoconductive drum 11M, a charger 12M, an exposure device 13M and a developing device 14M, a toner image corresponding to a magenta image and formed on a surface of the photoconductive drum 11M is transferred onto the intermediate transfer belt 20 moving in the Y-axis direction between the photoconductive drum 11M and the primary transfer roller 23M. The image forming unit 10C includes a photoconductive drum 11C, a charger 12C, an exposure device 13C and a developing device 14C, a toner image corresponding to a cyan image and formed on a surface of the photoconductive drum 11C is transferred onto the intermediate transfer belt 20 moving in the Y-axis direction between the photoconductive drum 11C and the primary transfer roller 23C. The image forming unit 10B includes a photoconductive drum 11B, a charger 12B, an exposure device 13B and a developing device 14B, a toner image corresponding to a black image and formed on a surface of the photoconductive drum 11B is transferred onto the intermediate transfer belt 20 moving in the Y-axis direction between the photoconductive drum 11B and the primary transfer roller 23B.

As described above, the toner images corresponding to the respective yellow, magenta, cyan and black images are successively transferred onto the intermediate transfer belt 20 as an intermediate transfer member to be superimposed into one toner image by the image forming units 10Y, 10M, 10C and 10B. The intermediate transfer belt 20 reciprocates in the Y-axis direction (sub scanning direction) by rotations of the conveyor rollers 21, 22. A moving speed of the intermediate transfer belt 20 and an image forming speed (speed until the development process is completed) by the image forming units 10Y, 10M, 10C and 10B are controlled to be so synchronized as not to cause any color shift when the toner images are successively transferred and superimposed on the intermediate transfer belt 20.

The secondary transfer roller 24 is arranged to face the conveyor roller 21 while sandwiching the intermediate transfer belt 20. A sheet P is conveyed from the sheet cassette 25 to between the secondary transfer roller 24 and the intermediate transfer belt 20 by the feed rollers 26. The toner images formed on the intermediate transfer belt 20 are collectively transferred (secondary transfer) onto the conveyed sheet P. The sheet P having the toner image formed by such a secondary transfer process is conveyed toward the fixing device 27.

The fixing device 27 includes a heating roller 27*a* and a pressure roller 27*b* arranged to face each other. The sheet P is heated and pressed between the heating roller 27*a* and the pressure roller 27*b*, whereby the toner image is fixed to the sheet P (fixing process). In this way, a desired full color image is formed on the sheet P. The sheet P formed with the full color image is discharged to the outside of an apparatus main body by the discharge rollers 28.

Figure 2:
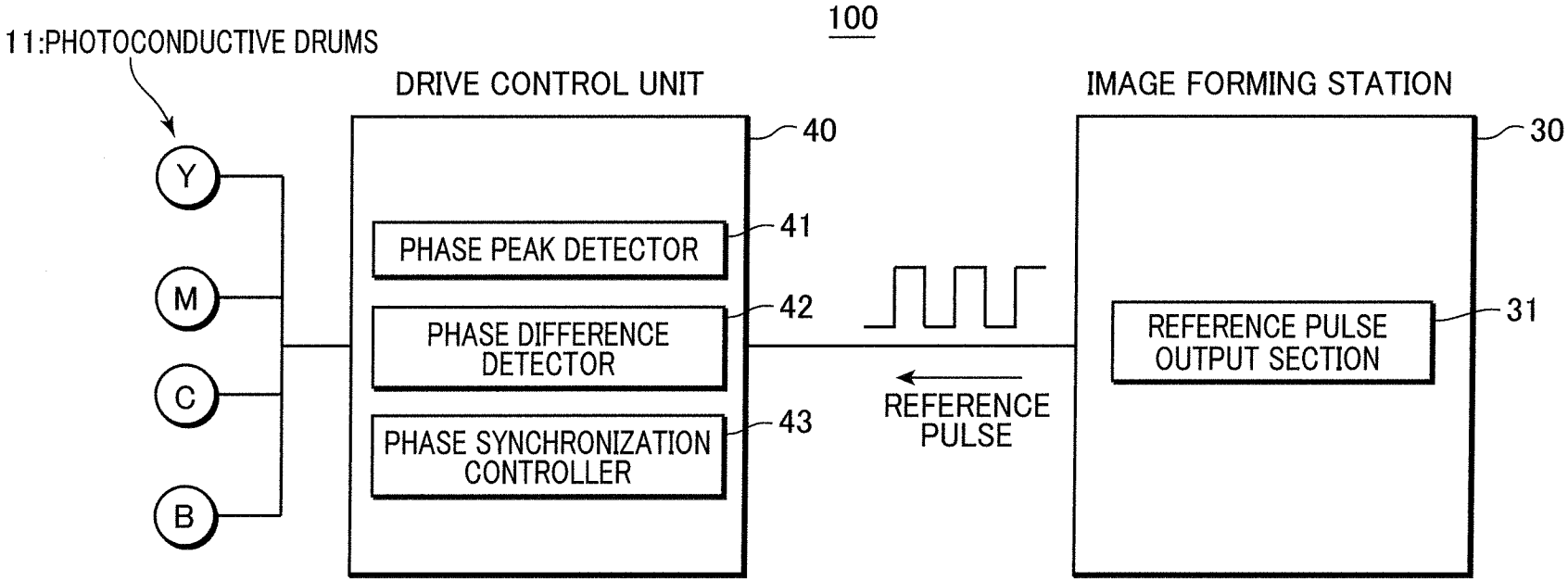
FIG. 2 is a block diagram showing a control construction of the image forming apparatus.

FIG. 2 is a block diagram showing a control construction of the image forming apparatus 100. The image forming apparatus 100 includes independent image forming station 30 and drive control unit 40 as control units for controlling the above respective parts. The image forming station 30 is a control unit mainly for forming toner images of the respective colors on the surfaces of the respective photoconductive drums 11, and the drive control unit 40 is a control unit mainly for rotating and driving the respective photoconductive drums 11.

The image forming station 30 includes a reference pulse output section 31. The reference pulse output section 31 generates a reference pulse having a cycle which is equal to or an integral multiple of a rotation cycle of the photoconductive drums 11 and outputs this reference pulse to the drive control unit 40. Such a reference pulse is generated using a timer function of a CPU and outputs as a rectangular wave having a cycle which is equal to or an integral multiple of an ideal rotation cycle of the photoconductive drums 11 to the drive control unit 40.

The drive control unit 40 includes a phase peak detector 41, a phase difference detector 42 and a phase synchronization controller 43.

The phase peak detector 41 detects a phase peak of the surface speed of each photoconductive drum 11. Here, the phase peak means a timing at which the surface speed is fastest or slowest during one turn of the photoconductive drum 11 in the case of observing the surface speed of each photoconductive drum 11 at a fixed point.

The phase peak of the surface speed of each photoconductive drum 11 can be specified from measurement values obtained by measuring the surface speed of each photoconductive drum 11 in real time. However, a more preferable method is a method by which a relationship between surface speed data of the respective photoconductive drums 11 measured in advance and rotational positions of the respective photoconductive drums 11 is stored in a memory (ROM; Read Only Memory) and the phase peaks are specified from the surface speed data read from the ROM. A construction necessary for this phase peak detection method is described below.

Figure 3:
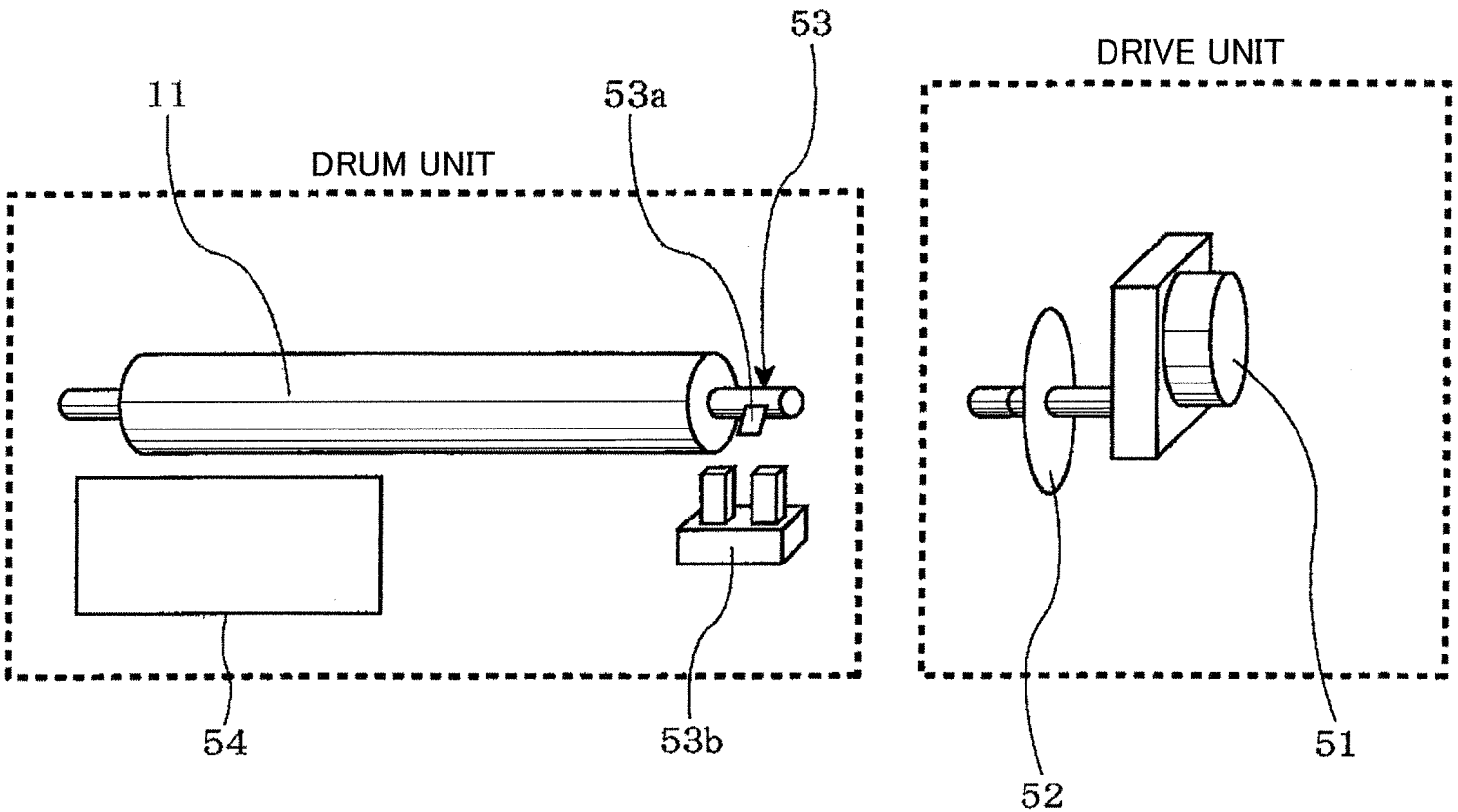
FIG. 3 and FIG. 4 are a diagram and a block diagram showing constructions necessary for a rotation speed control of photoconductive drums of the image forming apparatus.
Figure 4:
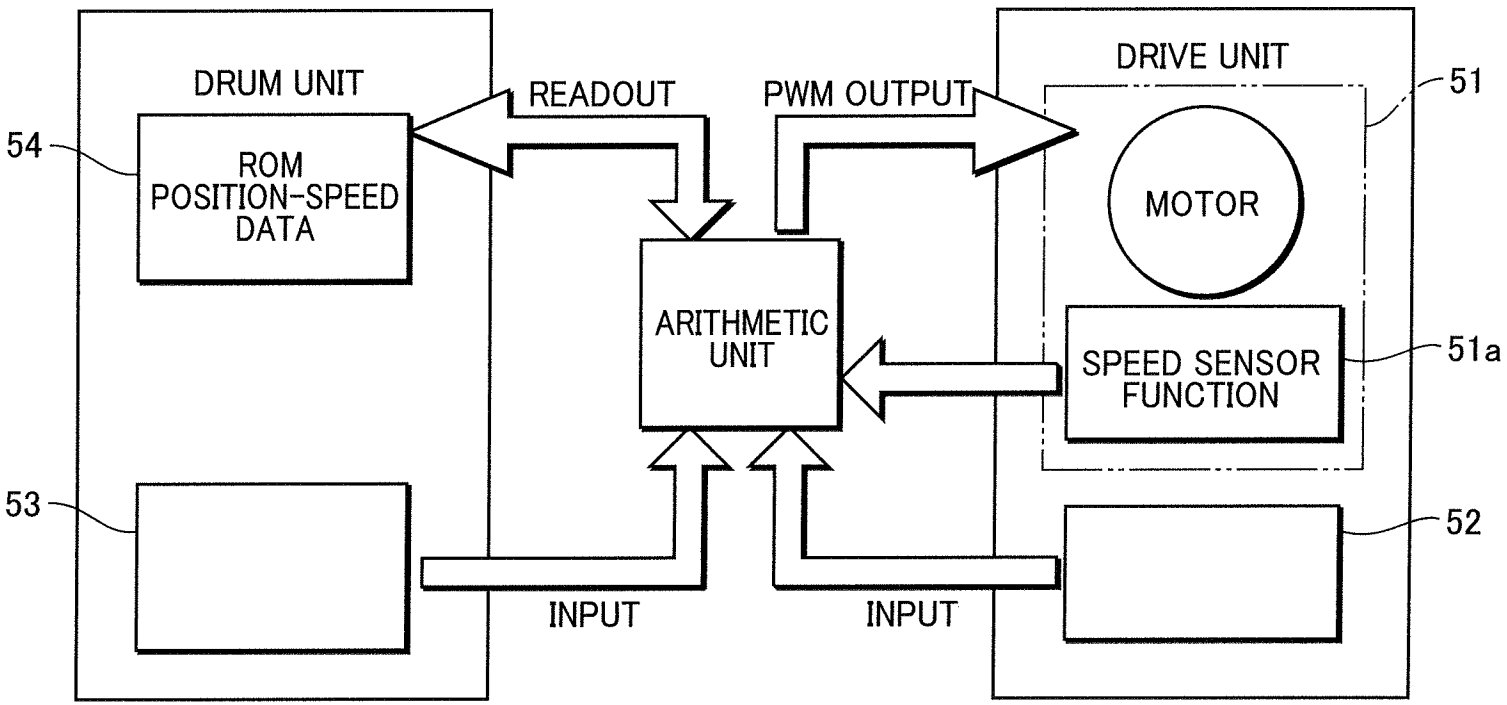

FIG. 3 is a diagram showing a construction necessary for a rotation speed control of the photoconductive drums 11 of the image forming apparatus 100. FIG. 4 is a block diagram showing a construction necessary for the rotation speed control of the photoconductive drums 11. A drive motor 51 for driving and rotating the photoconductive drum 11, a rotary encoder 52 for detecting a rotational position of the photoconductive drum 11, a reference position detection sensor 53 for detecting a rotation reference position of the photoconductive drum 11 and a ROM 54 for storing position-speed data of the photoconductive drum 11 are provided around each photoconductive drum 11.

The drive motor 51 is an electric motor whose speed is controlled by a PWM (Pulse Width Modulation) signal and has a function for outputting an FG (Frequency Generation) pulse of a frequency corresponding to an output rotation speed (speed sensor function 51*a*). In this embodiment, the rotation speed control of the drive motor 51 is performed while this FG pulse is fed back to an arithmetic unit.

The rotary encoder 52 detects the rotational position of the photoconductive drum 11 by detecting a rotational position of a motor output shaft of the drive motor 51 or that of a drum shaft of the photoconductive drum 11.

The reference position detection sensor 53 includes a light blocking blade 53*a* mounted on the drum shaft and a photointerrupter 53*b* for optically detecting the passage of the light blocking blade 53*a*. The reference position detection sensor 53 outputs a reference position signal per rotation of the photoconductive drum 11.

The relationship between the surface speed data of the respective photoconductive drums 11 measured in advance and the reference positions of the photoconductive drums 11 is stored in the ROM 54. Thus, it becomes possible to read the surface speed data of the photoconductive drum 11 as needed and specify the phase peak of the surface speed based on a detection result on the reference position of the photoconductive drum 11.

Figure 5A:
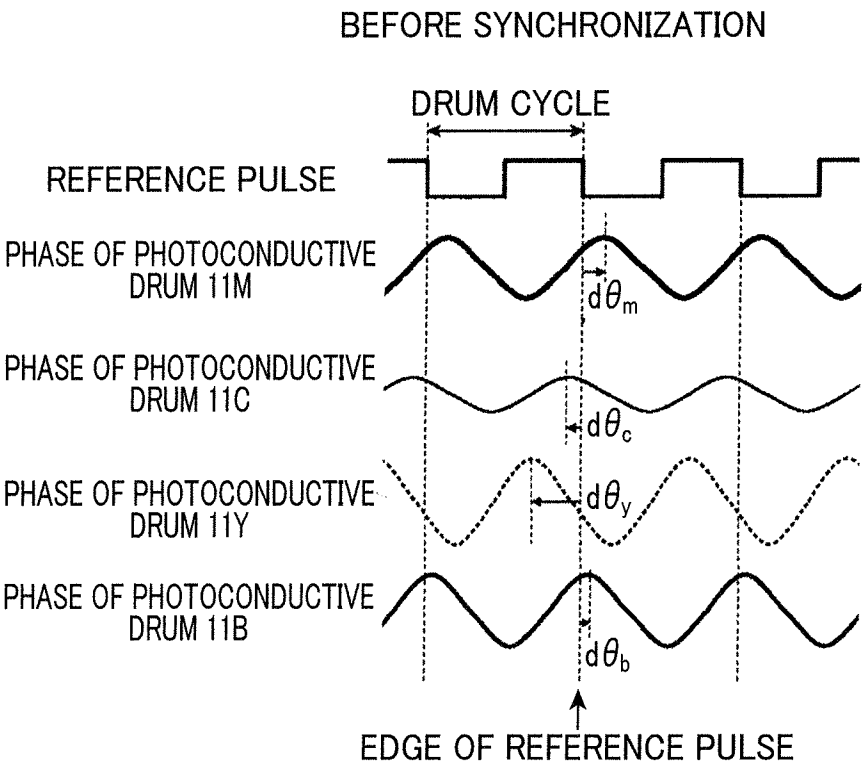
FIGS. 5A and 5B are timing charts showing an example of a phase synchronization control of the image forming apparatus.

The phase difference detector 42 detects a phase difference between an edge of the reference pulse and the phase peak of each photoconductive drum 11. An example shown in FIG. 5A shows that the phase peak of the photoconductive drum 11M is ahead by a phase difference dθm with respect to a falling edge of the reference pulse, the phase peak of the photoconductive drum 11C lags behind by a phase difference dθc with respect to the above edge, the phase peak of the photoconductive drum 11Y lags behind by a phase difference dθy with respect to the above edge, and the phase peak of the photoconductive drum 11B is ahead by a phase difference dθb with respect to the above edge.

Figure 5B:
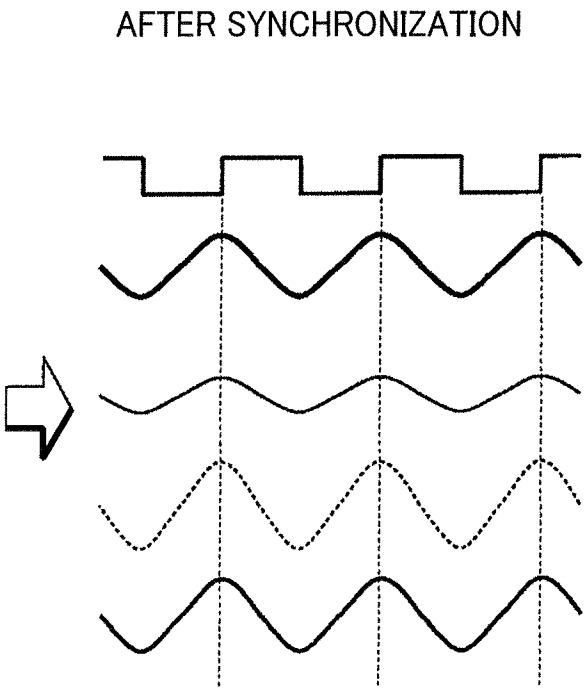

The phase synchronization controller 43 synchronizes the phases of the surface speeds of the respective photoconductive drums 11 by independently controlling the rotation speeds of the respective photoconductive drums 11 according to the phase differences dθ. For example, as shown in FIG. 5B, the phase synchronization controller 43 performs the rotation speed control independently on the respective photoconductive drums 11 so that the phase differences dθ of the respective photoconductive drums 11 with respect to the edge of the reference pulse become zero.

Figure 6A:
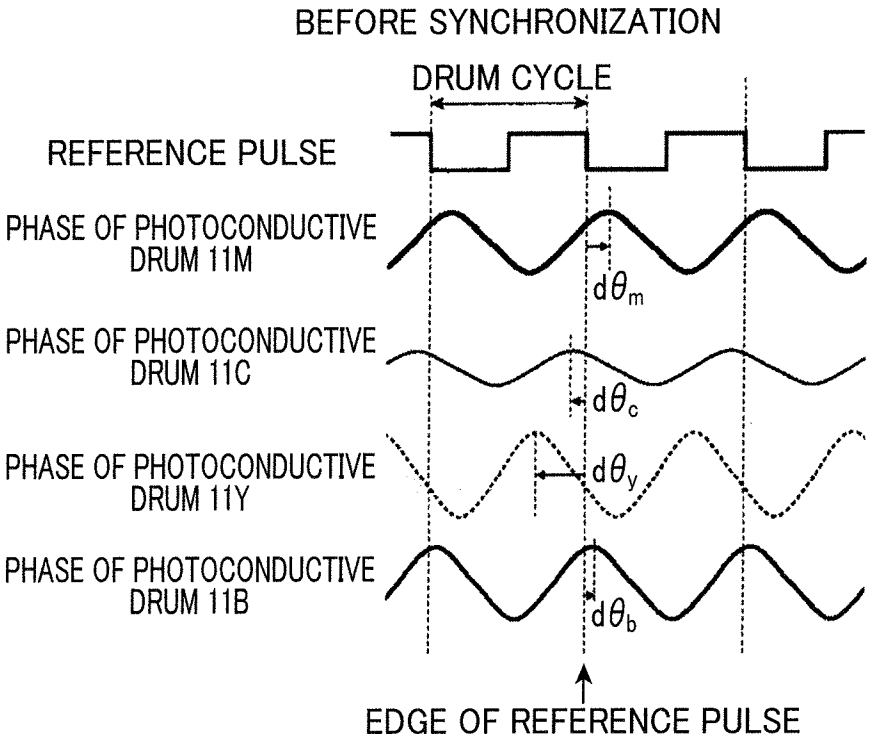
FIGS. 6A, 6B are timing charts showing another example of the phase synchronization control.
Figure 6B:
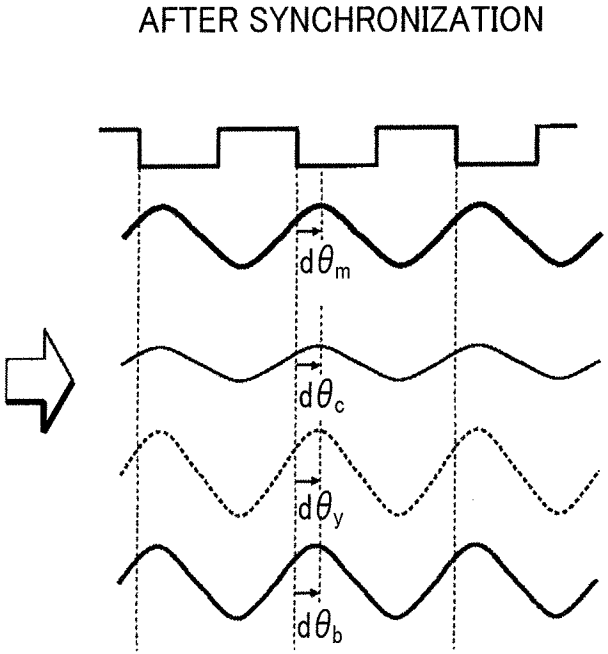

A case may be supposed where the rotation speeds of only three photoconductive drums 11 can be changed due to a mechanical construction. In this case, when there are phase peak differences as shown in FIG. 6A (the same phase peak differences as in FIG. 5A are illustrated), the phase synchronization controller 43 performs the rotation speed control independently on the photoconductive drums 11C, 11Y and 11B using the phase difference dθm of the photoconductive drum 11M whose rotation speed cannot be changed so that the phase differences dθc, dθy and dθb of the other photoconductive drums 11C, 11Y and 11B coincide with the phase difference dθm.

Figure 7:
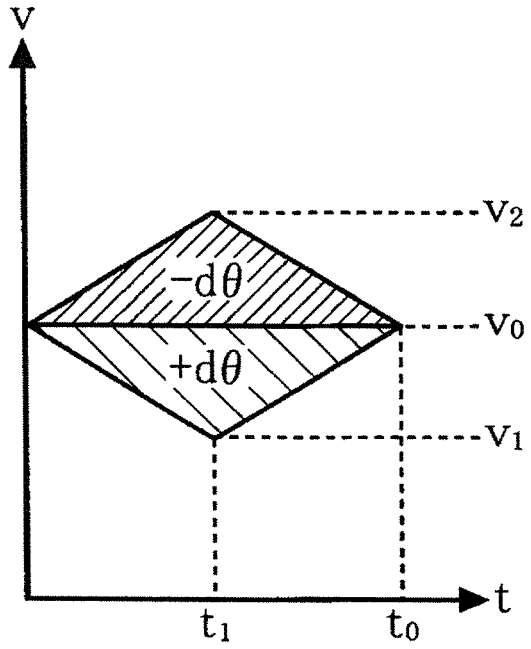
FIG. 7 is a timing chart showing a rotation speed control used in the phase synchronization control.

FIG. 7 is a timing chart showing the rotation speed control used in the phase synchronization control of the image forming apparatus 100. In order to synchronize the phases of the respective photoconductive drums 11 controlled to rotate at a constant speed (speed=v0), if the phase difference dθ is positive (phase advance), the rotation speed of the photoconductive drum 11 is decelerated at a constant deceleration rate until the phase difference dθ is halved (speed v1 at time t1) and, thereafter, accelerated at a constant acceleration rate of the same magnitude as the constant deceleration rate up to an initial speed (speed v0 at time t0). Further, if the phase difference dθ is negative (phase delay), the rotation speed of the photoconductive drum 11 is accelerated at a constant acceleration rate until the phase difference dθ is halved (speed v2 at time t1) and, thereafter, decelerated at a constant deceleration rate of the same magnitude as the constant acceleration rate up to the initial speed (speed v0 at time t0). A process procedure of the phase synchronization control using such a rotation speed control is described below.

Figure 8:
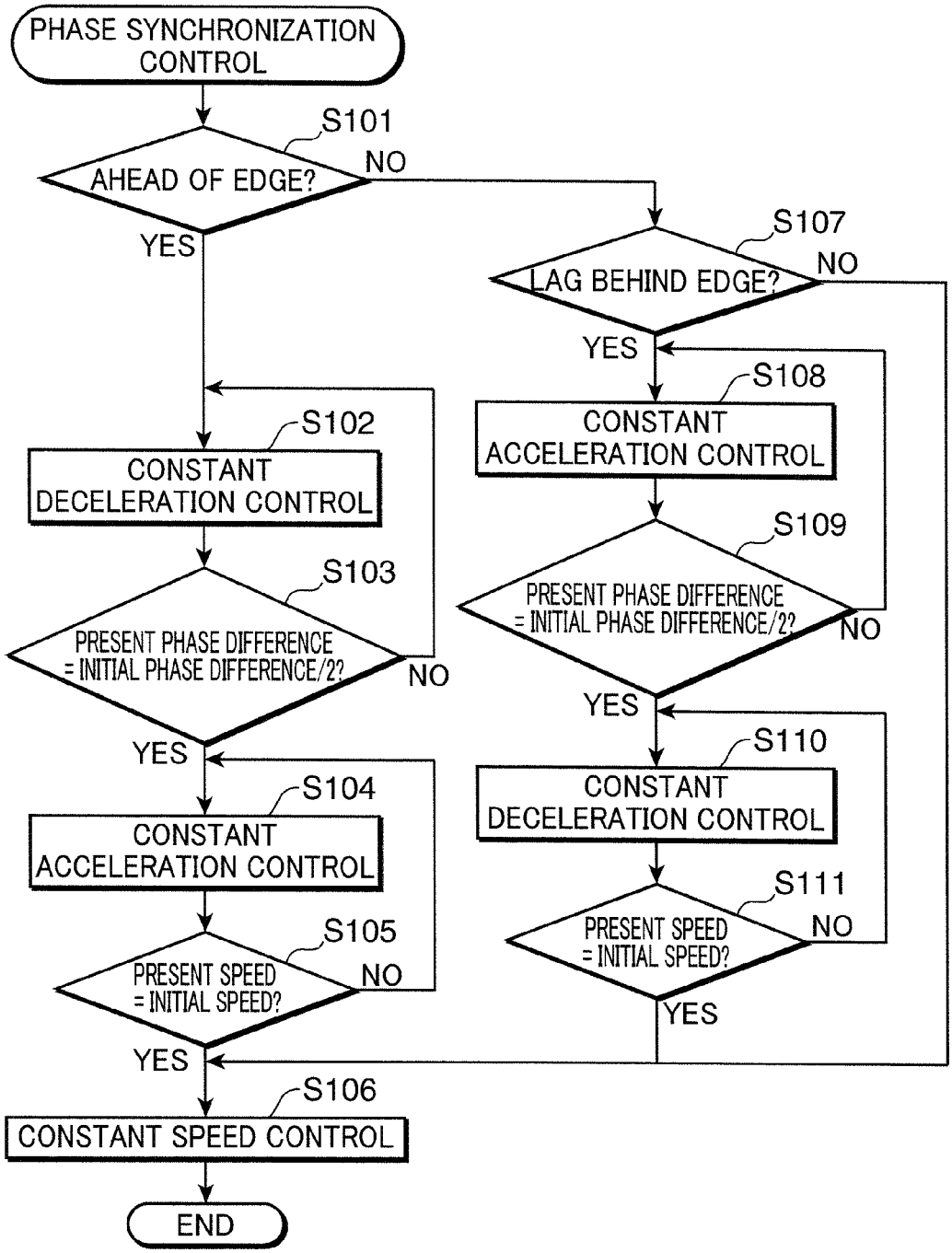
FIG. 8 is a flow chart showing a process procedure of the phase synchronization control.

FIG. 8 is a flow chart showing the process procedure of the phase synchronization control of the image forming apparatus 100 according to the first embodiment. In the phase synchronization control of this embodiment, the phase difference detector 42 judges whether or not the phase difference dθ indicates an advance with respect to the edge of the reference pulse for each photoconductive drum 11 whose phase is to be synchronized (S101).

If the phase difference is judged to indicate an advance (Yes in S101), the phase difference detector 42 judges whether or not the present phase difference has been reduced to ½ or below the initial phase difference dθ (S103) while the phase synchronization controller 43 performs a constant deceleration control for decelerating the rotation speed of the photoconductive drum 11 at a constant deceleration rate (S102).

If the present phase difference is judged to be ½ or below the initial phase difference dθ (Yes in S103), the phase synchronization controller 43 performs a constant acceleration control for accelerating the rotation speed of the photoconductive drum 11 at a constant acceleration rate (S104).

Specifically, it is assumed that V1 denotes the rotation speed of the photoconductive drum 11 when the present difference became ½ of the initial phase difference dθ and V0 denotes the initial speed (original speed), the phase synchronization controller 43 accelerates the rotation speed of the photoconductive drum 11 at the acceleration rate of the same magnitude as the deceleration rate when the constant deceleration control was performed from V1. Subsequently, whether or not the present speed has reached the initial speed V0 is judged (S105).

If the present speed is judged to have reached the initial speed V0 (Yes in S105), the phase synchronization controller 43 transfers to a constant speed control for rotating the photoconductive drum 11 at a constant speed (S106).

On the other hand, if the phase difference is judged to indicate no advance in Step S101 (No in S101), whether or not the phase difference dθ indicates a delay with respect to the edge of the reference pulse is judged (S107).

If the phase difference is judged to indicate no delay (No in S107), there is no phase difference, wherefore the constant speed control is performed (S106). On the other hand, if the phase difference detector 42 judges that the phase difference indicates a delay, the phase synchronization controller 43 performs the constant acceleration control for accelerating the rotation speed of the photoconductive drum 11 at a constant acceleration rate (S108). In parallel with this, the phase difference detector 42 judges whether or not the present phase difference is ½ or below the initial phase difference dθ (S109).

If the present phase difference is judged to be ½ or below the initial phase difference dθ (Yes in S109), the phase synchronization controller 43 performs the constant deceleration control for decelerating the rotation speed of the photoconductive drum 11 at a constant deceleration rate (S110).

Specifically, if it is assumed that V2 denotes the rotation speed of the photoconductive drum 11 when the present difference became ½ of the initial phase difference dθ and V0 denotes the initial speed (original speed), the phase synchronization controller 43 decelerates the rotation speed of the photoconductive drum 11 at the deceleration rate of the same magnitude as the acceleration rate when the constant acceleration control was performed from V2. Subsequently, whether or not the present speed has reached the initial speed V0 is judged (S111).

If the present speed is judged to have reached the initial speed V0 (Yes in S111), the phase synchronization controller 43 transfers to the constant speed control for rotating the photoconductive drum 11 at the constant speed (S106).

By performing the phase synchronization control as described above, the phase peaks of the respective photoconductive drums 11 can be recognized in the image forming station 30.

In other words, although the image forming station 30 and the drive control unit 40 are independently provided and the phase synchronization control of the respective photoconductive drums 11 is performed in the drive control unit 40, this phase synchronization control is a control for synchronizing the phase peaks of the respective photoconductive drums 11 with respect to an edge of a reference pulse output from the image forming station 30 to the drive control unit 40. Thus, the phase peaks of the respective photoconductive drums 11 can be recognized in the image forming station 30, wherefore an image forming process in conformity with the phases of the respective photoconductive drums 11 can be performed.

For example, the image forming station 30 can recognize the edge of the reference pulse by a timer compare interrupt, a hardware interrupt or the like and finely adjust an image writing timing and perform a registration correction.

[Second Embodiment]

Next, an image forming apparatus 100A according to a second embodiment of the present invention is described with reference to FIGS. 9 and 10. For a construction common to the first embodiment, the description of the first embodiment is employed by assigning the same reference as in the first embodiment.

Figure 9:
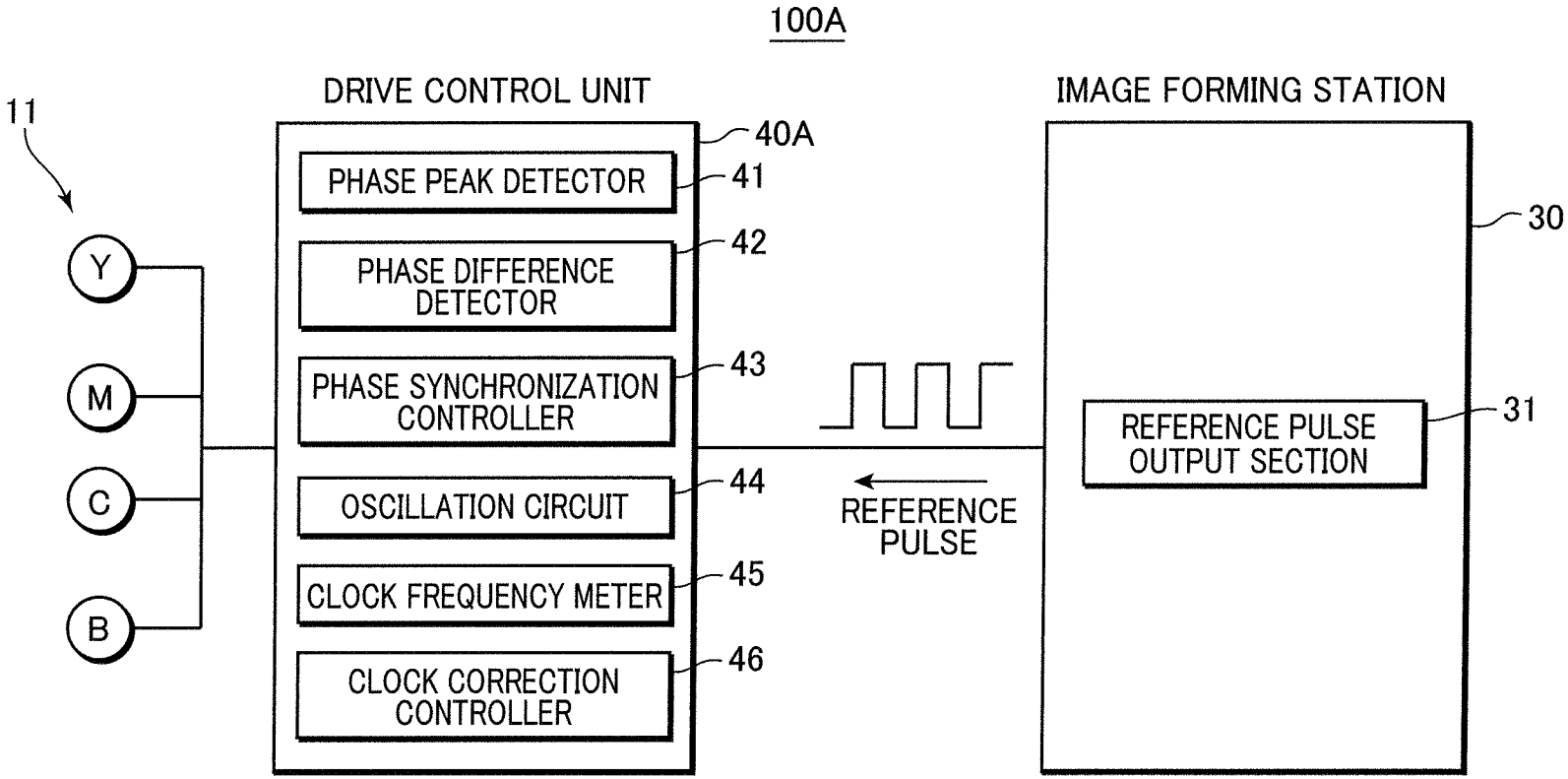
FIG. 9 is a block diagram showing a control construction of an image forming apparatus according to a second embodiment of the invention.

FIG. 9 is a block diagram showing a control construction of the image forming apparatus 100A. The image forming apparatus 100A according to the second embodiment differs from the first embodiment in that a drive control unit 40A includes an oscillation circuit 44 for generating clock signals, a clock frequency meter 45 for measuring the frequency of the clock signals based on a count number of the clock signals in one cycle of a reference pulse and a clock correction controller 46 for correcting the frequency of the clock signals based on the frequency measured by the clock frequency meter 45.

Such a drive control unit 40A can correct the frequency of the clock signals generated therein utilizing a reference pulse output from an image forming station 30 for phase synchronization control. As a result, a tolerance of the clock signals present between the image forming station 30 and the drive control unit 40A can be maximally reduced and the occurrence of color shift caused by this tolerance can be prevented.

Note that a method for correcting the frequency of the clock signals by the clock correction controller 46 is arbitrary. In a preferred embodiment, the clock correction controller 46 changes the frequency of the clock signals so that the count number of the clock signals in one cycle of the reference pulse becomes a predetermined number.

Accuracy in measuring the frequency of the clock signals by the clock frequency meter 45 increases as the cycle of the reference pulse becomes longer. The reason for this is that if the cycle of the reference pulse is short, the count number of the clock signals becomes smaller and an error resulting from a fraction of the count number becomes larger. Accordingly, upon commonly using the reference pulse for the phase synchronization control and clock correction control, it is preferable to set the cycle of the reference pulse at an integral multiple of a rotation cycle of photoconductive drums 11 at the time of the clock correction control.

On the other hand, it is preferable to set the cycle of the reference pulse equal to the rotation cycle of the photoconductive drums at the time of the phase synchronization control of the photoconductive drums 11. The reason for this is that a phase synchronization period of the photoconductive drums 11 can be shortened.

Accordingly, a reference pulse output section 31 of this embodiment outputs a reference pulse having a cycle equal to the rotation cycle of the photoconductive drums 11 when only a phase synchronization controller 43 operates out of the phase synchronization controller 43 and the clock correction controller 46 of the drive control unit 40A. On the other hand, when only the clock correction controller 46 operates or the phase synchronization controller 43 and the clock correction controller 46 simultaneously operate in the drive control unit 40A, the reference pulse output section 31 outputs a reference pulse having a cycle which is an integral multiple of the rotation cycle of the photoconductive drums 11.

Figure 10:
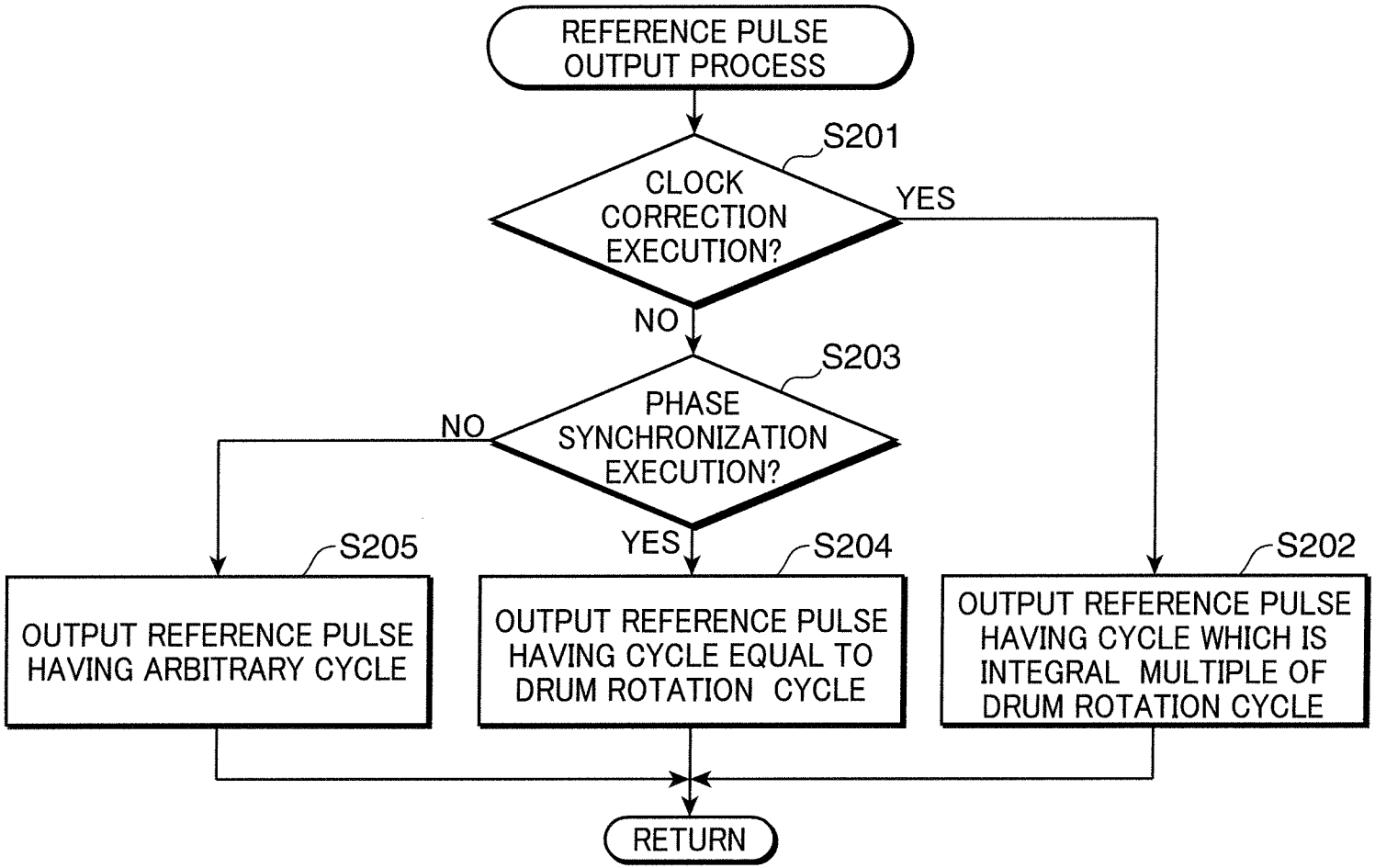
FIG. 10 is a flow chart showing a process procedure of a reference pulse output process of the image forming apparatus.

FIG. 10 is a flow chart showing a process procedure of a reference pulse output process of the image forming apparatus 100A according to the second embodiment. In this reference pulse output process, the reference pulse output section 31 first judges whether or not execution of the clock correction control has been instructed in the drive control unit 40A (S201). Here, if it is judged that execution of the clock correction control has been instructed (Yes in S201), the reference pulse output section 31 outputs a reference pulse having a cycle which is an integral multiple of the rotation cycle of the photoconductive drums 11 regardless of whether or not the phase synchronization control is to be performed (S202).

On the other hand, if it is judged that execution of the clock correction control has not been instructed (No in S201), whether or not execution of the phase synchronization control has been instructed in the drive control unit 40A is judged (S203). Here, if it is judged that execution of the phase synchronization control has been instructed (Yes in S203), the reference pulse output section 31 outputs a reference pulse having a cycle equal to the rotation cycle of the photoconductive drums 11 (S204). If it is judged that execution of the phase synchronization control has not been instructed (No in S203), the reference pulse output section 31 outputs a reference pulse having an arbitrary cycle (S205). For example, a reference pulse having a cycle in conformity with a control to be executed next is output.

According to the image forming apparatus 100A of the second embodiment constructed as above, the drive control unit 40A includes the oscillation circuit 44 for generating clock signals, the clock frequency meter 45 for measuring the frequency of the clock signals based on the count number of the clock signals in one cycle of the reference pulse, and the clock correction controller 46 for correcting the frequency of the clock signals based on the frequency measured by the clock frequency meter 45. Thus, the frequency of the clock signals generated in the drive control unit 40A can be corrected utilizing the reference pulse output from the image forming station 30 for the phase synchronization control. As a result, the tolerance of the clock signals present between the image forming station 30 and the drive control unit 40A can be maximally reduced and the occurrence of color shift caused by this tolerance can be prevented.

The reference pulse output section 31 of the second embodiment outputs a reference pulse having a cycle equal to the rotation cycle of the photoconductive drums when only the phase synchronization controller 43 operates in the drive control unit 40A while outputting a reference pulse having a cycle which is an integral multiple of the rotation cycle of the photoconductive drums when only the clock correction controller 46 operates or the phase synchronization controller 43 and the clock correction controller 46 simultaneously operate in the drive control unit 40A. Accordingly, although the reference pulse is commonly used for the phase synchronization control and the clock correction control, a time required for phase synchronization can be shortened while the accuracy in measuring the frequency of the clock signals is improved.

The present invention is described above by showing the embodiments. However, it goes without saying that the present invention is not limited only to the above embodiments and various changes can be made within the scope as claimed. The present invention is applicable to an image forming apparatus such as a copier or a printer for image formation using an electrophotographic method and an image forming method.

The above specific embodiments mainly include inventions having the following constructions.

An image forming apparatus according to one aspect of the present invention includes an image forming station including a plurality of photoconductive drums and adapted to form toner images on surfaces of the respective photoconductive drums; and a drive control unit for rotating and driving the plurality of photoconductive drums; wherein the image forming station includes a reference pulse output section for generating a reference pulse having a cycle which is equal to or an integral multiple of a rotation cycle of the photoconductive drums and outputting the reference pulse to the drive control unit; and the drive control unit includes a phase peak detector for detecting phase peaks of surface speeds of the respective photoconductive drums, a phase difference detector for detecting phase differences between an edge of the reference pulse and the phase peaks, and a phase synchronization controller for synchronizing phases of the surface speeds of the respective photoconductive drums by controlling rotation speeds of the respective photoconductive drums according to the phase differences.

An image forming method according to another aspect of the present invention is for forming toner images on surfaces of a plurality of photoconductive drums by rotating and driving the photoconductive drums, the method including the steps of generating a reference pulse having a cycle which is equal to or an integral multiple of a rotation cycle of the photoconductive drums and outputting the reference pulse to a drive control unit for driving and rotating the photoconductive drums; detecting phase peaks of surface speeds of the respective photoconductive drums; detecting phase differences between an edge of the output reference pulse and the phase peaks; and synchronizing phases of the surface speeds of the respective photoconductive drums by controlling rotation speeds of the respective photoconductive drums according to the phase differences.

According to these constructions, although the drive control unit and the image forming station are provided and a phase synchronization control of the respective photoconductive drums is performed in the drive control unit, it is possible to recognize the phase peaks of the respective photoconductive drums in the image forming station and perform an image forming process in conformity with the phases of the respective photoconductive drums.

This application is based on Japanese Patent application serial No. 2009-278527 filed in Japan Patent Office on Dec. 8, 2009, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising:

an image forming station including a plurality of photoconductive drums and adapted to form toner images on surfaces of the respective photoconductive drums; and a drive control unit for rotating and driving the plurality of photoconductive drums;

wherein:

the image forming station includes a reference pulse output section for generating a reference pulse having a cycle which is equal to a rotation cycle of the photoconductive drums or an integral multiple of the rotation cycle of the photoconductive drums and outputting the reference pulse to the drive control unit; and the drive control unit includes:

a phase peak detector for detecting phase peaks of surface speeds of the respective photoconductive drums, a phase difference detector for detecting phase differences between an edge of the reference pulse and the phase peaks, and a phase synchronization controller for synchronizing phases of the surface speeds of the respective photoconductive drums by controlling rotation speeds of the respective photoconductive drums according to the phase differences;

and wherein if the phase peak of the photoconductive drum to be synchronized is ahead of the edge of the reference pulse, the phase synchronization controller controls the phase of the photoconductive drum to be synchronized by decelerating the rotation speed of the photoconductive drum at a constant deceleration rate until the phase difference is halved, then accelerating the rotation speed at a constant acceleration rate of the same magnitude as the constant deceleration rate up to an initial speed and, thereafter, setting the rotation speed at a constant speed.

2. An image forming apparatus comprising:

an image forming station including a plurality of photoconductive drums and adapted to form toner images on surfaces of the respective photoconductive drums; and a drive control unit for rotating and driving the plurality of photoconductive drums;

wherein:

the image forming station includes a reference pulse output section for generating a reference pulse having a cycle which is equal to a rotation cycle of the photoconductive drums or an integral multiple of the rotation cycle of the photoconductive drums and outputting the reference pulse to the drive control unit; and the drive control unit includes:

a phase peak detector for detecting phase peaks of surface speeds of the respective photoconductive drums, a phase difference detector for detecting phase differences between an edge of the reference pulse and the phase peaks, and a phase synchronization controller for synchronizing phases of the surface speeds of the respective photoconductive drums by controlling rotation speeds of the respective photoconductive drums according to the phase differences; and wherein, if the phase peak of the photoconductive drum to be synchronized lags behind the edge of the reference pulse, the phase synchronization controller controls the phase of the photoconductive drum to be synchronized by accelerating the rotation speed of the photoconductive drum at a constant acceleration rate until the phase difference is halved, then decelerating the rotation speed at a constant deceleration rate of the same magnitude as the constant acceleration rate up to an initial speed and, thereafter, setting the rotation speed at a constant speed.

3. An image forming apparatus according to claim 1, wherein:

the phase peak detector detects the phase peak of the surface speed of one of the plurality of photoconductive drums;

the phase difference detector detects the phase difference between the edge of the reference pulse and the phase peak of the one photoconductive drum; and the phase synchronization controller synchronizes the phase of the one photoconductive drum and those of the other photoconductive drums by controlling the rotation speeds of the other photoconductive drums according to the phase differences.

4. An image forming apparatus according to claim 1, wherein the drive control unit further includes:

an oscillation circuit for generating clock signals;

a clock frequency meter for measuring the frequency of the clock signals based on a count number of the clock signals in one cycle of the reference pulse; and a clock correction controller for correcting the frequency of the clock signals based on the frequency measured by the clock frequency meter.

5. An image forming apparatus according to claim 4, wherein the reference pulse output section outputs a reference pulse having a cycle equal to the rotation cycle of the photoconductive drums when only a control by the phase synchronization controller is performed in the drive control unit.

6. An image forming apparatus according to claim 4, wherein the reference pulse output section outputs a reference pulse having a cycle which is an integral multiple of the rotation cycle of the photoconductive drums when only a control by the clock correction controller is performed or the control by the phase synchronization controller and the control by the clock correction controller are simultaneously performed in the drive control unit.

7. An image forming method for forming toner images on surfaces of a plurality of photoconductive drums by rotating and driving the photoconductive drums, comprising the steps of:

generating a reference pulse having a cycle which is equal to a rotation cycle of the photoconductive drums or an integral multiple of a rotation cycle of the photoconductive drums and outputting the reference pulse to a drive control unit for driving and rotating the photoconductive drums;

detecting phase peaks of surface speeds of the respective photoconductive drums;

detecting phase differences between an edge of the output reference pulse and the phase peaks;

synchronizing phases of the surface speeds of the respective photoconductive drums by controlling rotation speeds of the respective photoconductive drums according to the phase differences; and if the phase peak of the photoconductive drum to be synchronized is ahead of the edge of the reference pulse, the phase synchronization controller controls the phase of the photoconductive drum to be synchronized by decelerating the rotation speed of the photoconductive drum at a constant deceleration rate until the phase difference is halved, then accelerating the rotation speed at a constant acceleration rate of the same magnitude as the constant deceleration rate up to an initial speed and, thereafter, setting the rotation speed at a constant speed.

8. An image forming apparatus according to claim 2, wherein:

the phase peak detector detects the phase peak of the surface speed of one of the plurality of photoconductive drums;

the phase difference detector detects the phase difference between the edge of the reference pulse and the phase peak of the one photoconductive drum; and the phase synchronization controller synchronizes the phase of the one photoconductive drum and those of the other photoconductive drums by controlling the rotation speeds of the other photoconductive drums according to the phase differences.

9. An image forming apparatus according to claim 2, wherein the drive control unit further includes:

an oscillation circuit for generating clock signals;

a clock frequency meter for measuring the frequency of the clock signals based on a count number of the clock signals in one cycle of the reference pulse; and a clock correction controller for correcting the frequency of the clock signals based on the frequency measured by the clock frequency meter.

10. An image forming apparatus according to claim 9, wherein the reference pulse output section outputs a reference pulse having a cycle equal to the rotation cycle of the photoconductive drums when only a control by the phase synchronization controller is performed in the drive control unit.

11. An image forming apparatus according to claim 9, wherein the reference pulse output section outputs a reference pulse having a cycle which is an integral multiple of the rotation cycle of the photoconductive drums when only a control by the clock correction controller is performed or the control by the phase synchronization controller and the control by the clock correction controller are simultaneously performed in the drive control unit.

* * * * *